US005636605A

United States Patent [19]

Nomizo et al.

[11] Patent Number: 5,636,605

[45] Date of Patent: Jun. 10, 1997

[54] COMPOSITE INTAKE MANIFOLD FOR AN INTERNAL COMBUSTION ENGINE

[75] Inventors: Fumio Nomizo, Toyota; Masao Yasukawa, Okazaki, both of Japan

[73] Assignee: Toyota Jidosha K.K., Toyota, Japan

[21] Appl. No.: 493,546

[22] Filed: Jun. 22, 1995

[30] Foreign Application Priority Data

| | | | |
|---|---|---|---|
| Jun. 22, 1994 | [JP] | Japan | 6-140547 |
| Sep. 30, 1994 | [JP] | Japan | 6-236755 |
| Jun. 7, 1995 | [JP] | Japan | 7-140314 |

[51] Int. Cl.[6] ..... F02M 35/10

[52] U.S. Cl. ..... 123/184.61

[58] Field of Search ..... 123/184.61, 519 R, 123/184.21

[56] References Cited

U.S. PATENT DOCUMENTS

| | | | |
|---|---|---|---|
| 4,111,163 | 9/1978 | Ederer et al. | 123/184.61 |
| 5,003,933 | 4/1991 | Rush et al. | 123/519 |

FOREIGN PATENT DOCUMENTS

| | | | |
|---|---|---|---|
| 58-162724 | 9/1983 | Japan . | |
| 60-81547 | 5/1985 | Japan | 123/184.61 |
| 60-119360 | 6/1985 | Japan . | |
| 61-76119 | 5/1986 | Japan . | |
| 3-112560 | 11/1991 | Japan . | |
| 5065857 | 3/1993 | Japan | 123/184.61 |
| 6-213087 | 8/1994 | Japan | 123/184.61 |

OTHER PUBLICATIONS

SAE 930087 —1993 GM 3800 V6 Composite Upper Inlet Manifold.

*Primary Examiner*—Marguerite McMahon

*Attorney, Agent, or Firm*—Cushman, Darby & Cushman IP Group of Pillsbury Madison & Sutro LLP

[57] ABSTRACT

A composite intake manifold includes a first outer member, an inner member fitted within the first outer member, and a second outer member fixed to the first outer member. An intake port of the manifold includes a curved portion. The curved portion is defined by the inner member and at least one of the first outer member and the second outer member. The curved portion of the intake port is divided at a seam parallel to an axis of the curved portion of the intake port so that the respective members can be molded without using a molding core.

28 Claims, 13 Drawing Sheets

COMPOSITE INTAKE MANIFOLD FOR AN INTERNAL COMBUSTION ENGINE

BACKGROUND OF THE INVENTION

1. Field of the Invention

The present invention relates to an integrally combined intake manifold/surge tank structure (hereinafter, a composite intake manifold) composed of a plurality of molded members, for an internal combustion engine.

2. Description of Related Art

Recently, to improve torque and power characteristics at low and medium engine speeds, a longer intake passage between a surge tank and a cylinder (hereinafter, an intake port) of an internal combustion engine has been needed. To arrange a long intake port in the limited space of an automobile engine compartment, it is useful to wind the intake port in the form of an arc, as disclosed in Japanese Utility Model Publication SHO 61-76119.

However, there is a problem with the above-noted conventional intake port structure.

More particularly, in order to manufacture a curved intake port by molding aluminum or synthetic resin, it is necessary to use a molding core having a complicated structure, resulting in manufacturing cost increases.

Another method for manufacturing an intake manifold from a plurality of molded members is disclosed in SAE-930087. However, in this type of conventional composite intake manifold, the intake port is straight. If the straight intake port is arranged in a limited space, it will be necessarily short.

SUMMARY OF THE INVENTION

An object of the invention is to provide a composite intake manifold formed from of a plurality of molded members, having a curved (wound) intake port and being manufactured without using a core.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
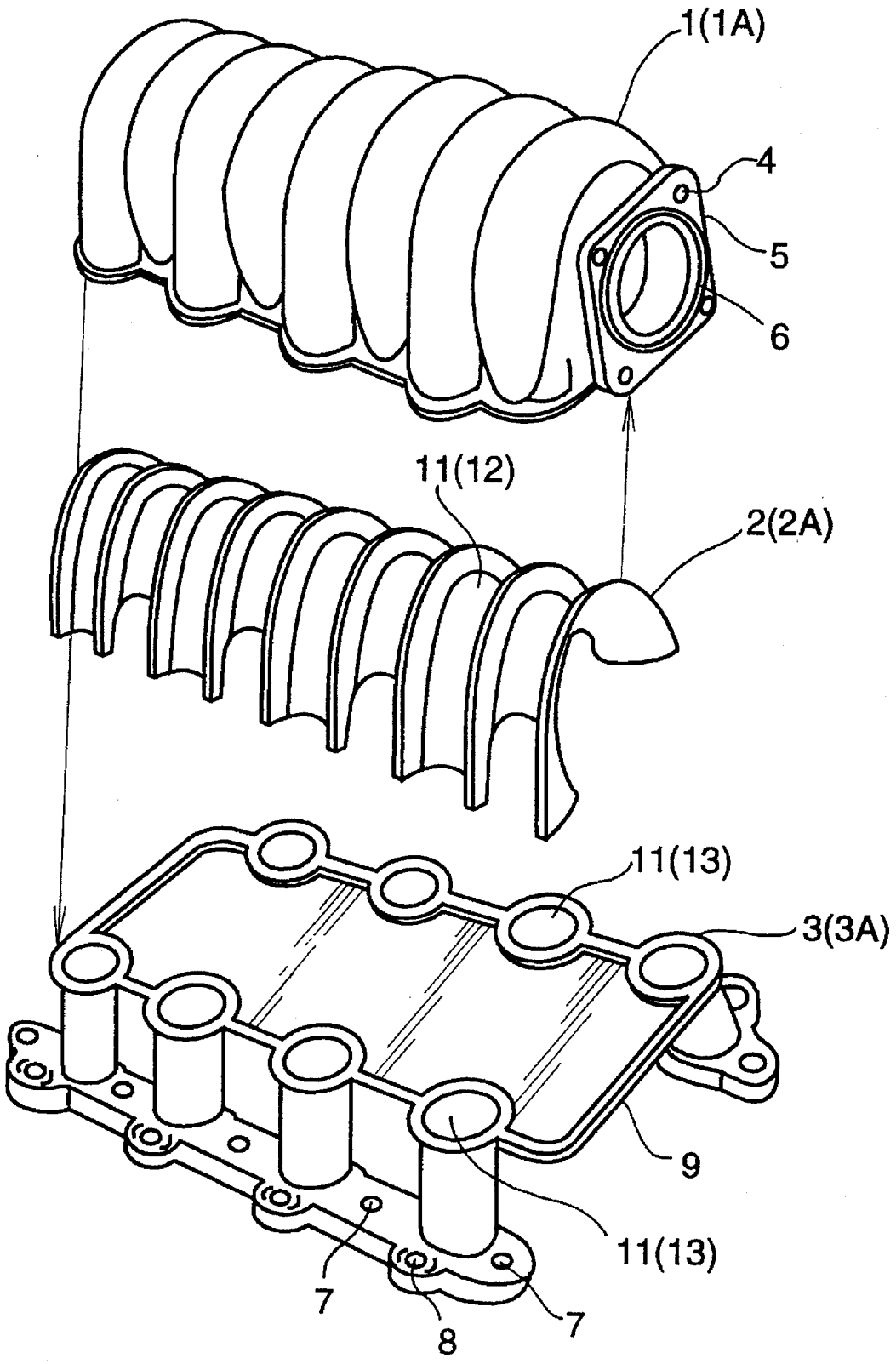
FIG. 1 is an exploded perspective view of a composite intake manifold according to first to fifth embodiments of the present invention.
Figure 2:
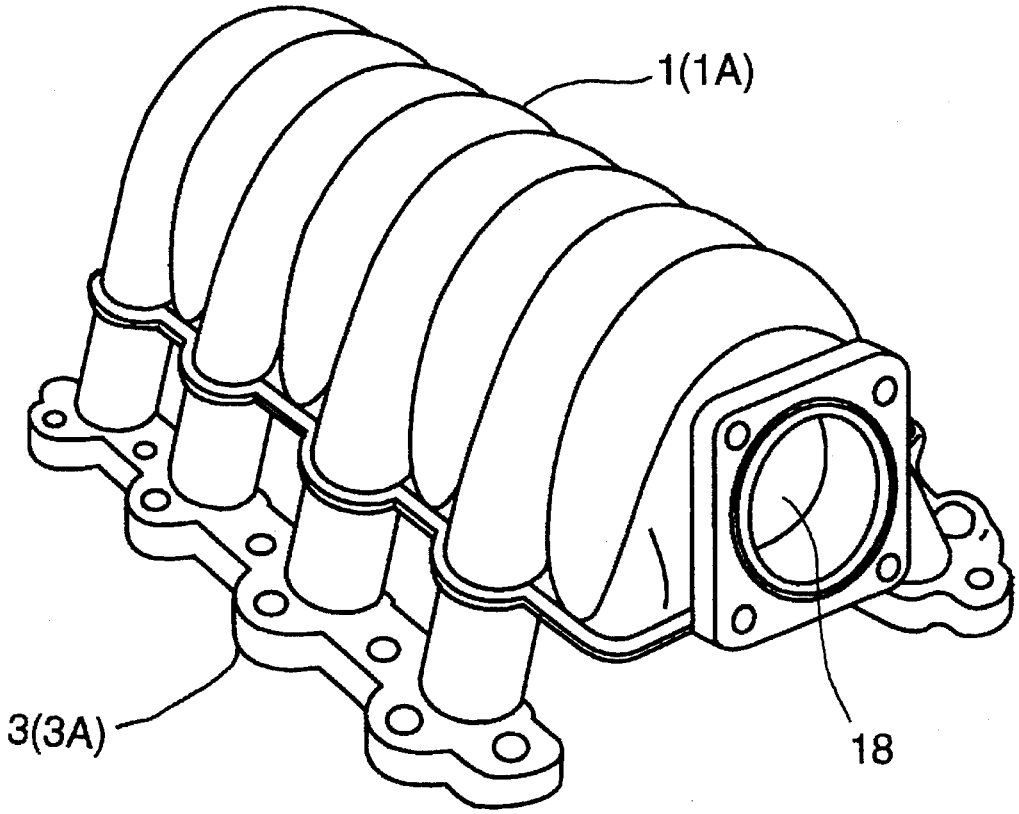
FIG. 2 is a perspective view of the assembled composite intake manifold according to the first to fifth embodiments of the present invention.

Eleven embodiments of the present invention will be explained below. Parts which are common or similar to all of the embodiments of the present invention are denoted with the same reference numerals with respect to all of the embodiments. Suffixes A–K correspond to first to eleventh embodiments of the present invention, respectively.

First, structures and advantages thereof common to all embodiments of the present invention will be explained with reference to, for example, FIGS. 1–4.

A composite intake manifold for an internal combustion engine according to any embodiment of the present invention comprises an integrally formed intake manifold/surge tank structure composed of a plurality of molded members, which are collectively coupled to an internal combustion engine of an automobile.

The composite intake manifold includes a first outer member 1, an inner member 2 fitted within the first outer member 1, and a second outer member 3 fixed to the first outer member 1. The first outer member 1 and the second outer member 3 hold the inner member 2 therebetween.

The first outer member 1, the inner member 2, and the second outer member 3 collectively define at least one intake port 11. Each intake port 11 includes a curved portion 12 at at least a portion of the intake port 11. The intake port 11 may include a straight portion 13 also at another portion of the intake port 11. The curved portion 12 of the intake port 11 is defined by the inner member 2 and at least one of the first outer member 1 and the second outer member 3.

The curved portion 12 of the intake port 11 is divided at a seam 22 which is located in a surface including an axis of the curved portion 12 of the intake port 11 and extending substantially parallel to a longitudinal axis of the composite intake manifold. A portion 11*c* of is defined by the inner member 2, and a portion 11*a* and/or 11*b* of the curved portion 12 is defined by at least one of the first outer member 1 and the second outer member 3.

The first outer member 1, the inner member 2, and the second outer member 3 are preferably molded without using a molding core. Preferably, injection molding is used because of its low cost and high dimensional accuracy.

The inner member 2 is made from a synthetic resin material. The first outer member 1 may be constructed of synthetic resin or an aluminum alloy. The second outer member 3 may be constructed of synthetic resin or an aluminum alloy.

The composite intake manifold includes a surge tank portion 17 therein. The surge tank portion 17 is defined by the inner member 2 and the second outer member 3. The surge tank portion 17 has an inlet 18 (see FIG. 2). Intake gas which enters the surge tank portion 17 through the inlet 18 then flows through an intake port 11 to a respective cylinder of the internal combustion engine.

The inner member 2 is only fitted within the first outer member 1 or may be only partially bonded to the first outer member 1, and is not fixedly bonded to the first outer member 1 and the second outer member 3. The first outer member 1 and the second outer member 3 are bonded or otherwise fixed to each other by, for example, an adhesive or through vibration welding.

Figure 3:
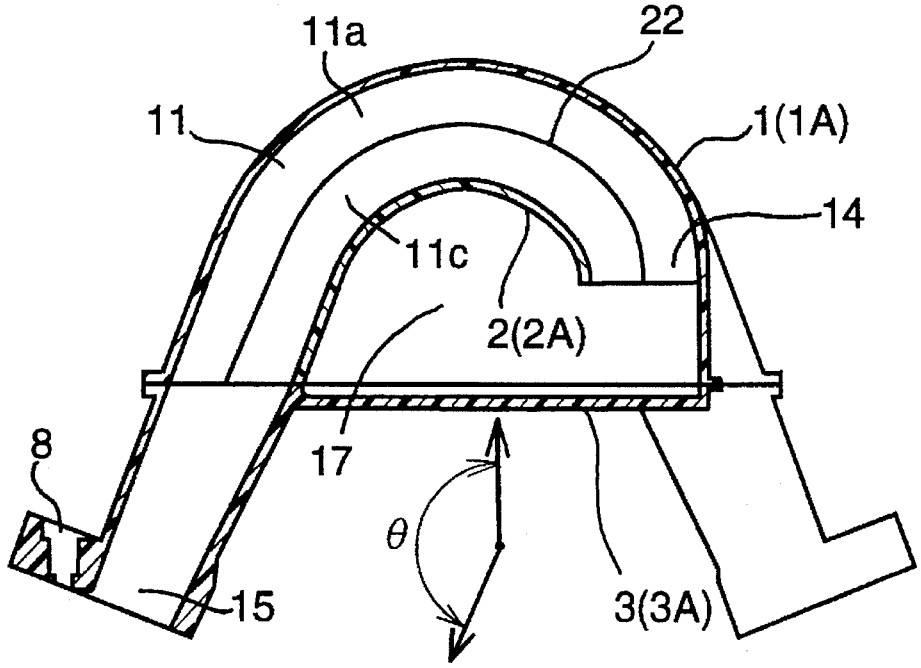
FIG. 3 is a transverse cross-sectional view of the composite intake manifold according to the first embodiment of the present invention.

The intake port 11 has a port inlet 14 for receiving intake gas from the surge tank portion 17 and a port outlet 15 for discharging the intake gas to a respective cylinder of the engine (see FIG. 3). A bell mouth 16 (FIG. 5) may be formed at the port inlet 14 for reducing gas flow resistance.

Advantages of the above-described structure are as follows.

Since the intake port 11 includes the curved portion 12, the effective length of intake port 11 can be lengthened. Generally, in a case where the intake port is lengthened, torque and power characteristics of the engine are improved at low and medium engine speeds. In contrast, when the intake port is relatively short, torque and power characteristics are improved at high engine speeds. Since the intake port 11 of the composite intake manifold according to the present invention is long, it is preferable to use the composite intake manifold according to the present invention for a sedan-type automobile to improve the torque and power characteristics at low and medium engine speeds.

Since the intake port 11 has a curved portion, the composite intake manifold normally could not be injection-molded without using a core.

However, in the present invention, since the curved portion 12 of the intake port 11 is divided into two portions at the seam 22 along an axis of the curved portion 12, it can be easily injection-molded without using a core. The molding cost is low because a core is unnecessary, and injection molding is well-suited for mass production.

The inner member 2 is coupled to at least one of the first outer member 1 and the second outer member 3. In this instance, since the inner member 2 is only fitted in or is only partially bonded to the outer member and is not fully bonded thereto, a bonding step is removed from the manufacturing process. As a result, manufacturing cost reduction and easy formation of the intake port 11 are realized. In the structure according to the present invention, a small amount of gas may leak between adjacent intake ports at the seam 22. However, such a small amount of leakage between adjacent intake ports would not cause serious problems, compared to the gas leakage between an intake port and the environment outside the intake manifold. Since the first outer member 1 and the second outer member 3 are bonded to each other, no leakage between the intake ports and the outside environment occurs in the composite intake manifold of the present invention.

The composite intake manifold is coupled to a cylinder head of the engine by bolts which pass through bolt holes 7 formed in the composite intake manifold (see FIG. 1). A throttle body (not shown) is coupled to the composite intake manifold by bolts which pass through the bolt holes 4 formed in a flange portion 5 of the composite intake manifold. The throttle body and the flange portion 5 are sealed with each other by an O-ring (not shown) which is fitted in a groove 6. An injector is coupled to the composite intake manifold using bolts which pass through bolt holes 8.

Structures and advantages thereof unique to each embodiment of the present invention will now be explained. In this regard, the embodiments of the present invention are grouped into two groups: a first group including the first to eighth embodiments wherein an angle θ between an axis of an inlet portion of the curved portion 12 of the intake port 11 and an axis of an outlet portion of the curved portion 12 of the intake port 11 is equal to or less than 180°, and a second group including the ninth to eleventh embodiments wherein the angle θ is greater than 180°. The greater the angle θ is, the longer the intake port 11 can be.

With the first embodiment of the present invention, as illustrated in FIGS. 1–4, the composite intake manifold is for a V-8 engine. All of the first outer member 1A, the inner member 2A, and the second outer member 3A are constructed from a synthetic resin material. After the inner member 2A is fitted within the first outer member 1A, the first outer member 1A and the second outer member 3A are bonded to each other by, for example, an adhesive or vibration welding to form an assembly.

In the second outer member 3A also, a straight port portion 13 of the intake port 11 is formed. The straight port portion 13 has a peripheral port wall which is continuous in a circumferential direction of the port and is not separated into portions by a seam including the port axis.

The intake port portion 13 formed in the second outer member 3A is provided on each side of the longitudinal axis of the composite intake manifold.

The first outer member 1A and the inner member 2A form a plurality of hollow curved portions 12 of the intake ports 11 extending parallel to each other. The outlet portion of the intake ports are provided in alternating fashion along the longitudinal axis of the composite intake manifold. That is, two adjacent curved portions 12 of the intake ports 11 are directed in opposite directions with respect to one another.

The angle θ between the inlet portion and the outlet portion of the curved portion 12 of the intake port 11 is greater than 90° in the first embodiment of the present invention, as shown in FIG. 3. Because of this large angle, the intake port 11 is relatively long.

Figure 4:
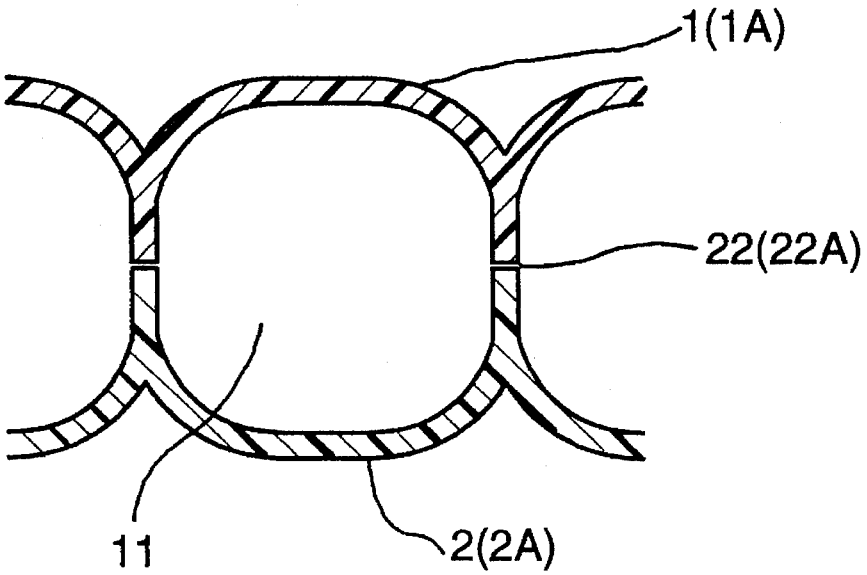
FIG. 4 is a partial cross-sectional view of an intake port of the composite intake manifold according to the first embodiment of the present invention.

Further, in the first embodiment of the present invention, as shown in FIG. 4, port wall edges of the first outer member 1A and port wall edges of the inner member 2A contact each other or are opposed to each other with a small clearance at the seams 22A. The structure is simple and of low cost.

Figure 5:
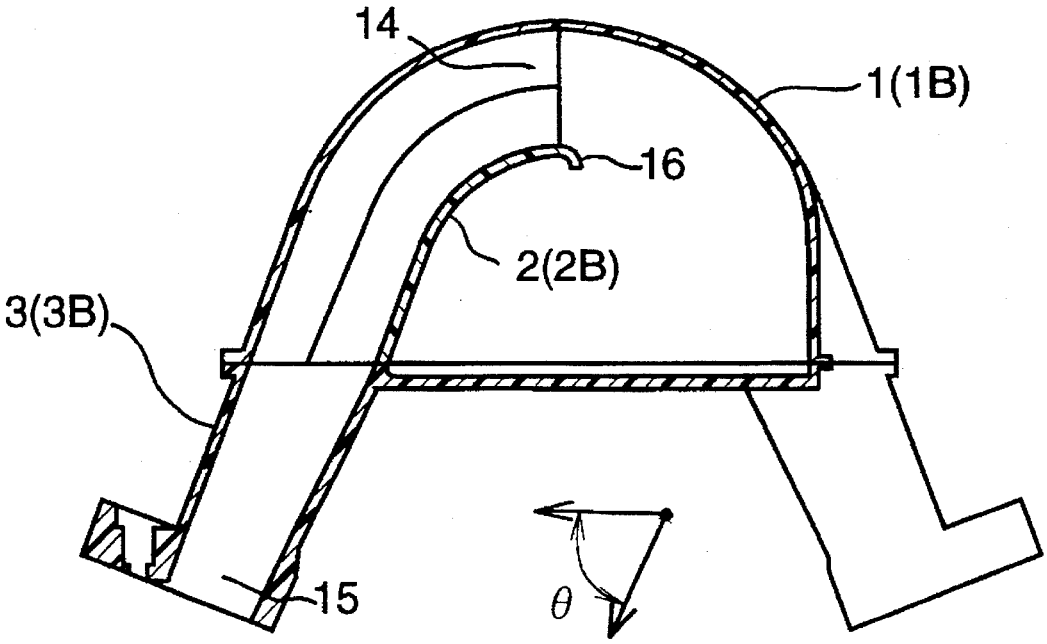
FIG. 5 is a transverse cross-sectional view of the composite intake manifold according to the second embodiment of the present invention.

With the second embodiment of the present invention, as illustrated in FIG. 5, an angle θ between the inlet portion and the outlet portion of the curved portion 12 of the intake port 11 is equal to or less than 90°. Because of this small angle, the intake port 11 of the second embodiment is shorter than that of the first embodiment, but is longer than the conventional intake port. As a result, torque and power characteristics at high engine speeds are improved compared to those of the first embodiment, and torque and power characteristics at low and medium engine speeds are improved compared to those of conventional engines. Other structures and advantages of the second embodiment are the same as those of the first embodiment.

Figure 6:
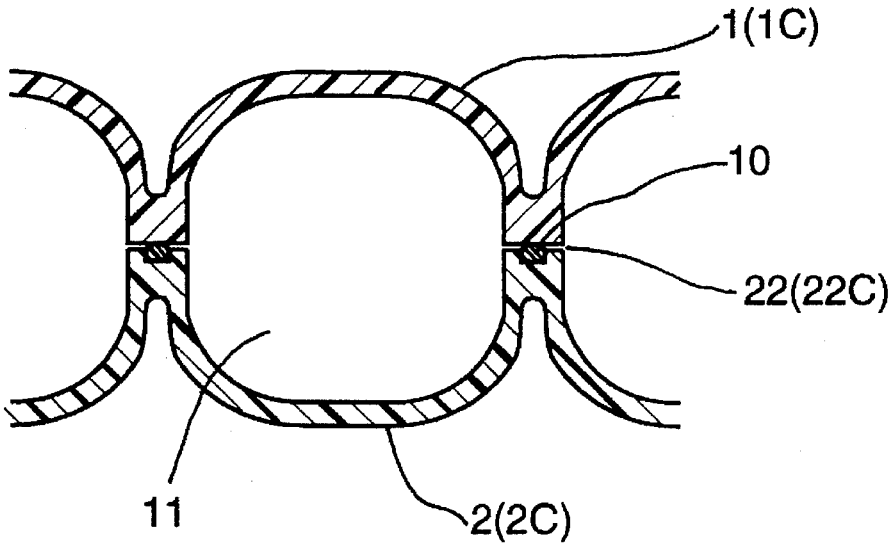
FIG. 6 is a partial cross-sectional view of an intake port of the composite intake manifold according the third embodiment of the present invention.

With the third embodiment of the present invention, as illustrated in FIG. 6, the first outer member 1C and the inner member 2C have respective intake port wall edge surfaces opposed to each other at the seams 22C of the intake port 11. One of the opposed surfaces has a groove formed therein where a seal member 10 is fitted. Because of this structure, sealing at the seams 22C is better than that of the first embodiment, and torque and power characteristics are higher than those of the first embodiment. Other structures and advantages are the same as those of the first embodiment of the present invention.

Figure 7:
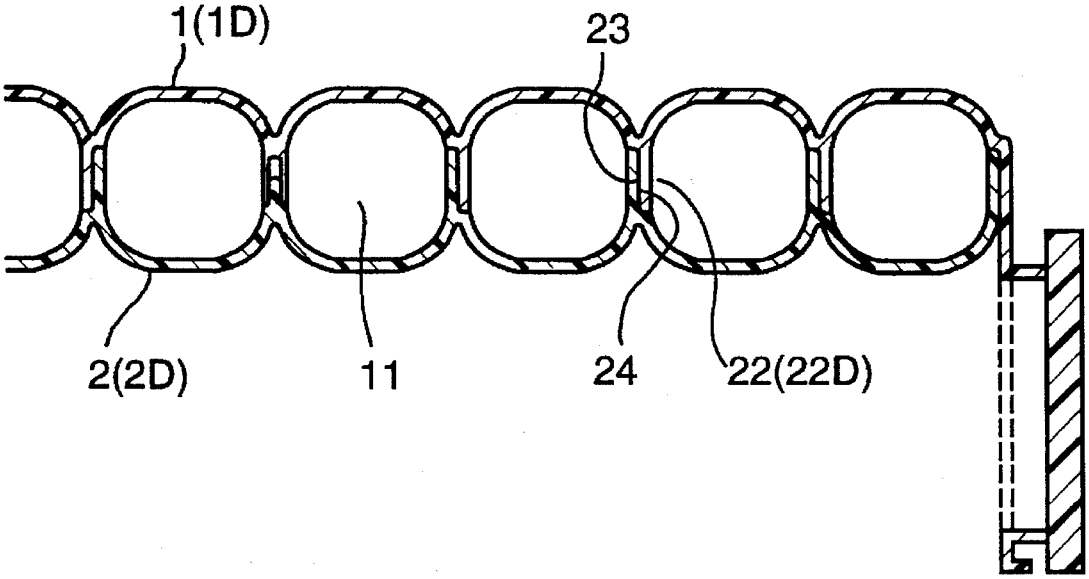
FIG. 7 is a partial cross-sectional view of an intake port of the composite intake manifold according to the fourth embodiment of the present invention.

With the fourth embodiment of the present invention, as illustrated in FIG. 7, the first outer member 1D and the inner member 2D have sealing surfaces 23 and 24, respectively, extending perpendicularly to the longitudinal axis of the composite intake manifold at the seams 22D of the intake port 11. The sealing surfaces 23 of the first outer member 1D and the sealing surfaces 24 of the inner member 2D can engage each other. The fitting directions of the seal surfaces 23 and 24 are the same with all seams 22D of the intake port 11. That is, sealing surface 23 is always provided, for example, to the right (as illustrated in FIG. 7) of sealing surface 24. This could obviously be switched so that sealing surface 23 is provided to the left of sealing surface 24. Because the sealing surfaces 23 and 24 extend along the length of seams 22D, the resultant sealing area is large. Therefore, the seal formed between two adjacent intake ports 11 is substantially perfect. Because of this structure, the torque and power of an engine provided with an intake manifold according to the fourth embodiment of the present invention are higher than an engine provided with an intake manifold of the first embodiment of the present invention. Other structures and advantages are the same as those of the first embodiment of the present invention, however.

Figure 8:
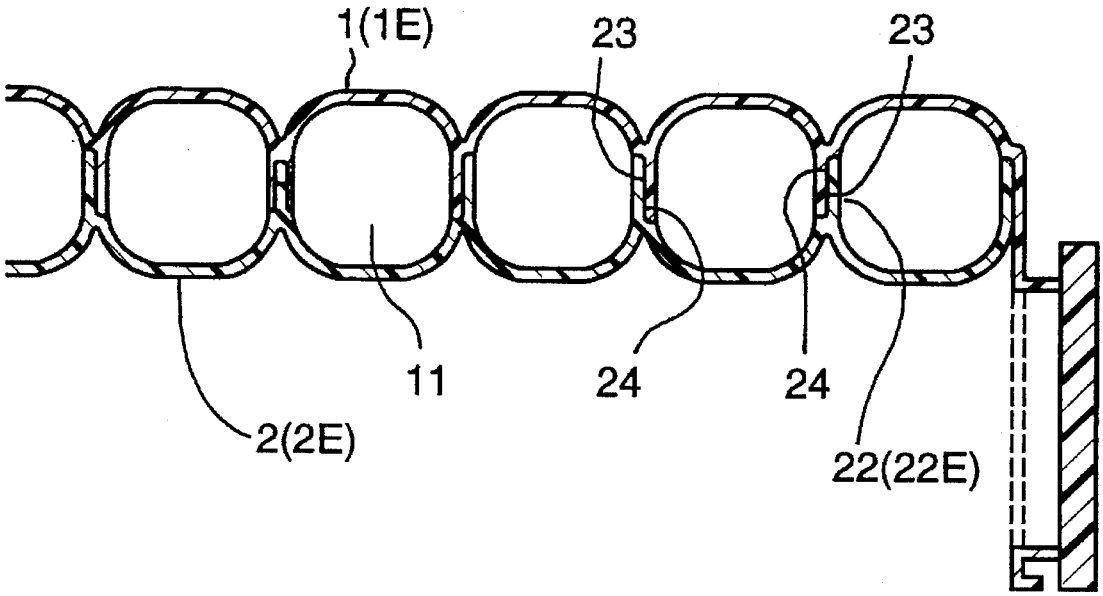
FIG. 8 is a partial cross-sectional view of an intake port of the composite intake manifold according to the fifth embodiment of the present invention.

With the fifth embodiment of the present invention, as illustrated in FIG. 8, the first outer member 1E and the inner member 2E have sealing surfaces 23 and 24, respectively, extending perpendicularly to the longitudinal axis of the composite intake manifold along the seams 22E of the intake port 11. The sealing surfaces 23 of the first outer member 1E and the sealing surfaces 24 of the inner member 2E fit each other. In this embodiment, sealing surfaces 23 and 24 are provided in alternating manner relative to each other at each seam 22E of the intake ports, in contrast to the manifold structure illustrated in FIG. 7. Because sealing surfaces 23 and 24 have a large overlapping area and an alternating interrelation, improved sealing is realized according to the fifth embodiment of the present invention than in the first and fourth embodiments of the present invention. Other structures and advantages are generally the same as those of the first embodiment of the present invention.

Figure 9:
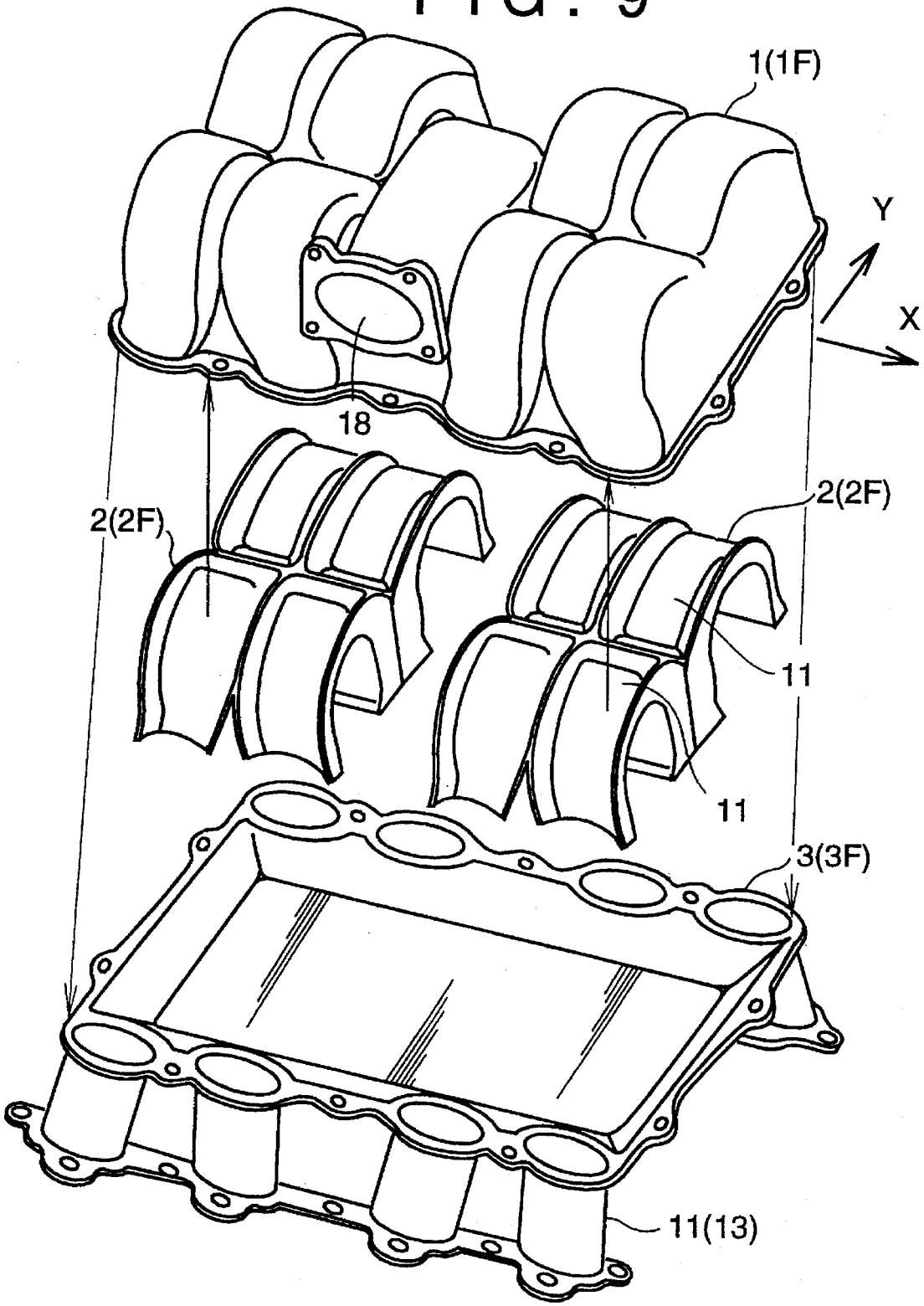
FIG. 9 is an exploded perspective view of a composite intake manifold according to the sixth embodiment of the present invention.
Figure 10:
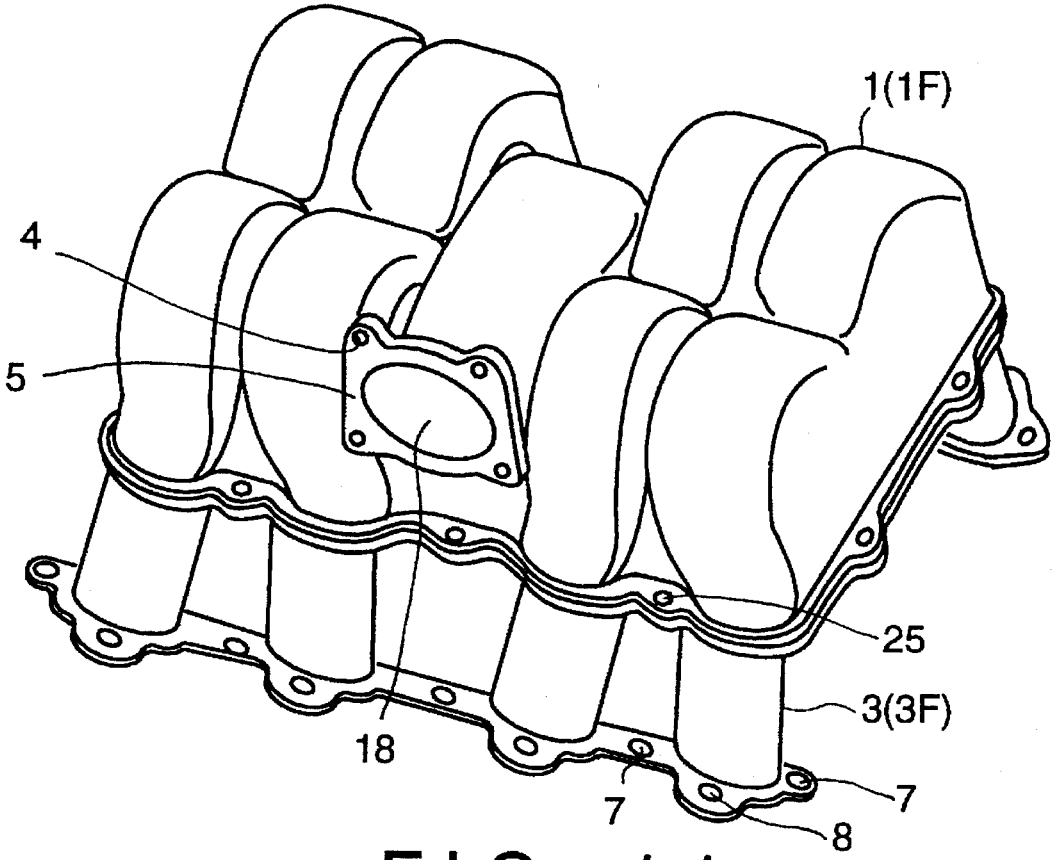
FIG. 10 is a perspective view of the composite intake manifold after assembly according to the sixth embodiment of the present invention.
Figure 11:
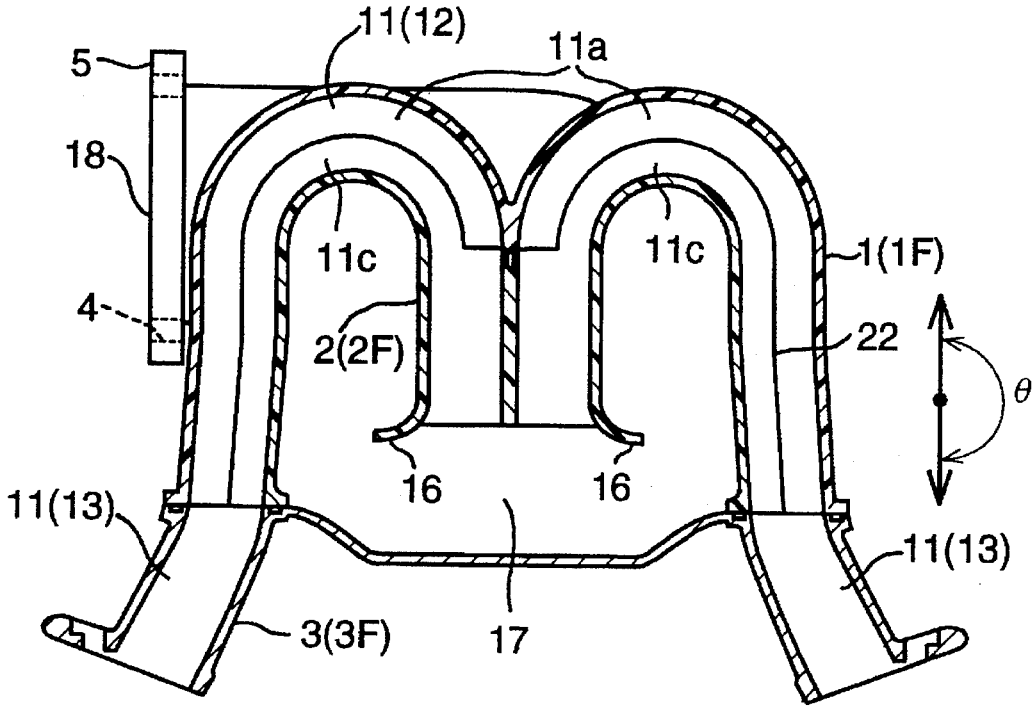
FIG. 11 is a transverse cross-sectional view of the composite intake manifold according to the sixth embodiment of the present invention.

With the sixth embodiment of the present invention, as illustrated in FIGS. 9 to 11, an intake gas inlet 18 is provided at a central portion (relative to the longitudinal (X-direction) direction) of the composite intake manifold. At least one pair (two pairs, in FIG. 10) of intake ports is provided at each side of the longitudinal central portion of the composite intake manifold. One intake port 11 of the at least one pair of intake ports extends from a transverse central portion of the composite intake manifold to one transverse end portion of the composite intake manifold in a width direction (Y-direction) of the composite intake manifold, and the other intake port 11 of the at least one pair of intake ports extends from a transverse central portion of the composite intake manifold to the other transverse end portion of the composite intake manifold in the width direction of the composite intake manifold. An intermediate portion of the intake port 11 between the transverse central portion and the transverse end portion is curved.

The first outer member 1F and the inner member 2F are constructed from, for example, synthetic resin, and the second outer member 3F is constructed of, for example, aluminum alloy. After the inner member 2F is fitted within the first outer member 1F, the first outer member 1F and the second outer member 3F are fixed to each other by bolts which pass through bolt holes 25.

The second outer member 3F forms another portion (a straight portion 13) of the intake port 11 therein. The portion 13 of each intake port 11 is provided on each side of the longitudinal axis of the composite intake manifold. In FIG. 10, for example, there are eight intake ports for an eight-cylinder internal combustion engine.

In the intake port arrangement of the sixth embodiment of the present invention, the composite intake manifold is shorter in the longitudinal direction of the composite intake manifold and is longer in the width direction of the composite intake manifold than the composite intake manifold according to the first embodiment of the present invention. This type of the composite intake manifold provides adaptability to the shape of an installation space.

Figure 12:
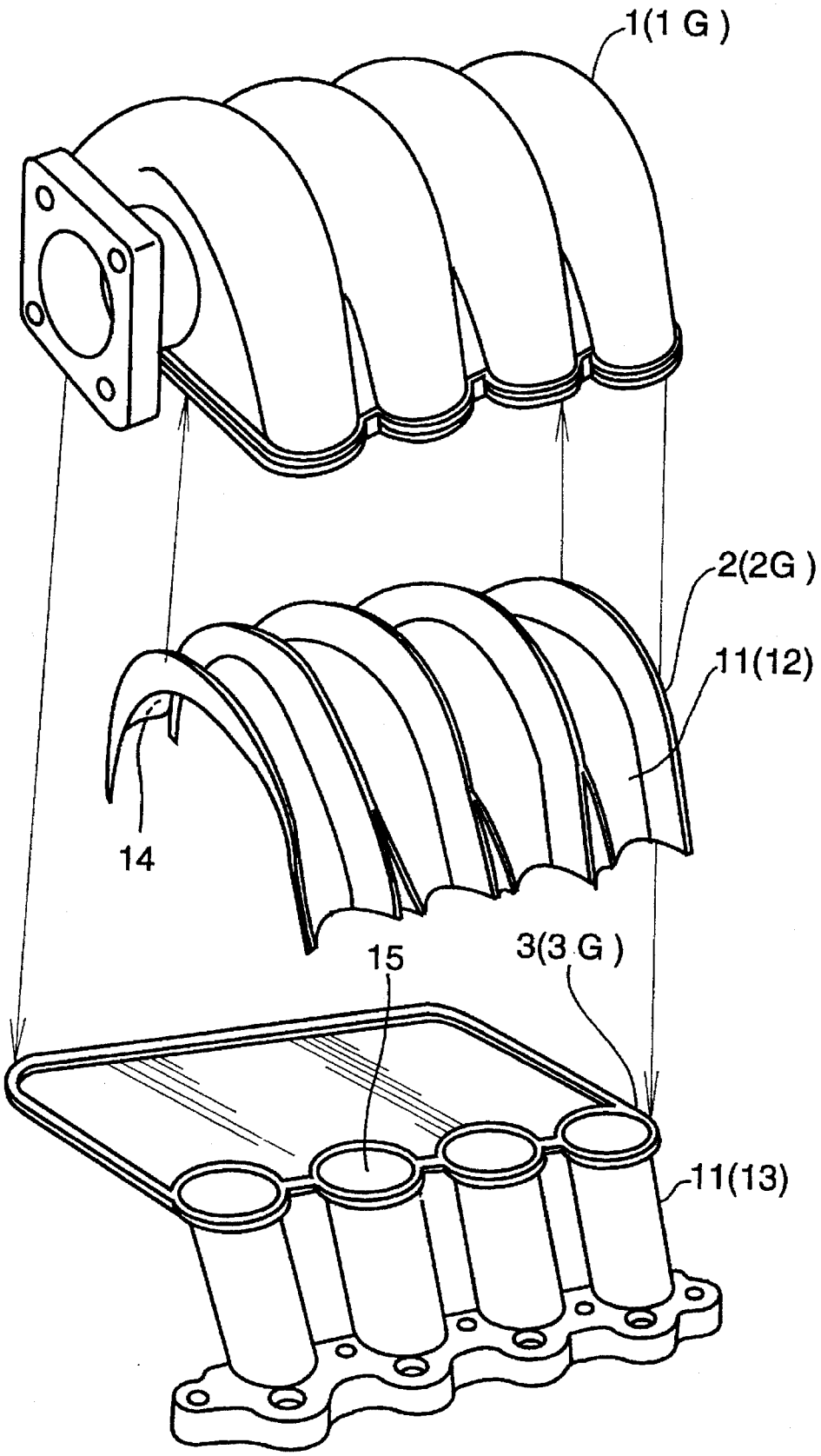
FIG. 12 is an exploded perspective view of a composite intake manifold according to a seventh embodiment of the present invention.
Figure 13:
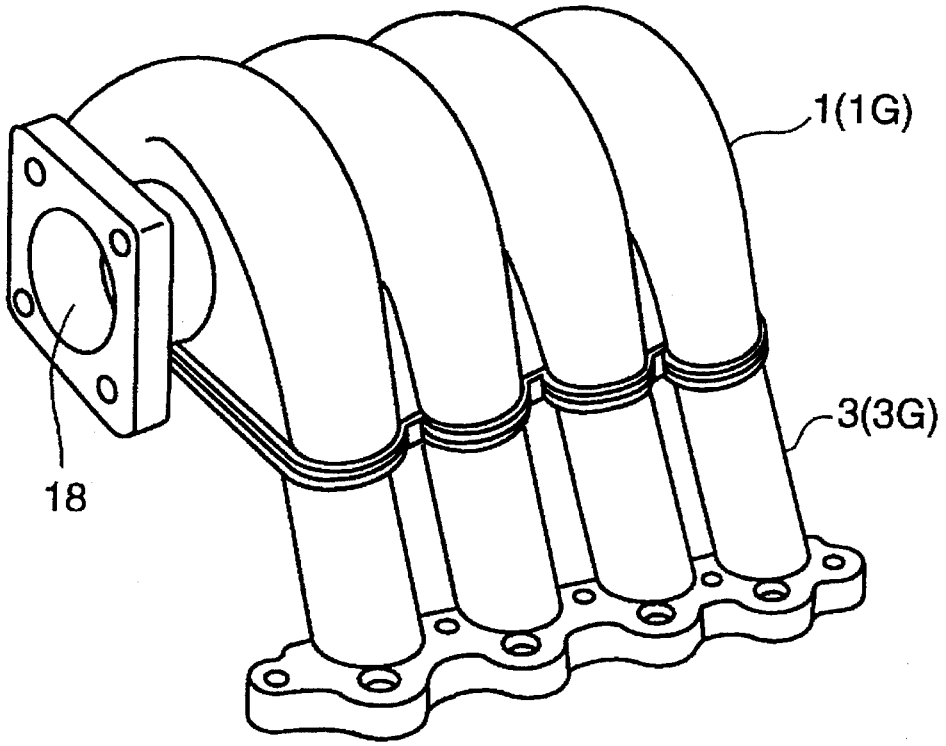
FIG. 13 is a perspective view of the composite intake manifold after assembly according to the seventh embodiment of the present invention.
Figure 14:
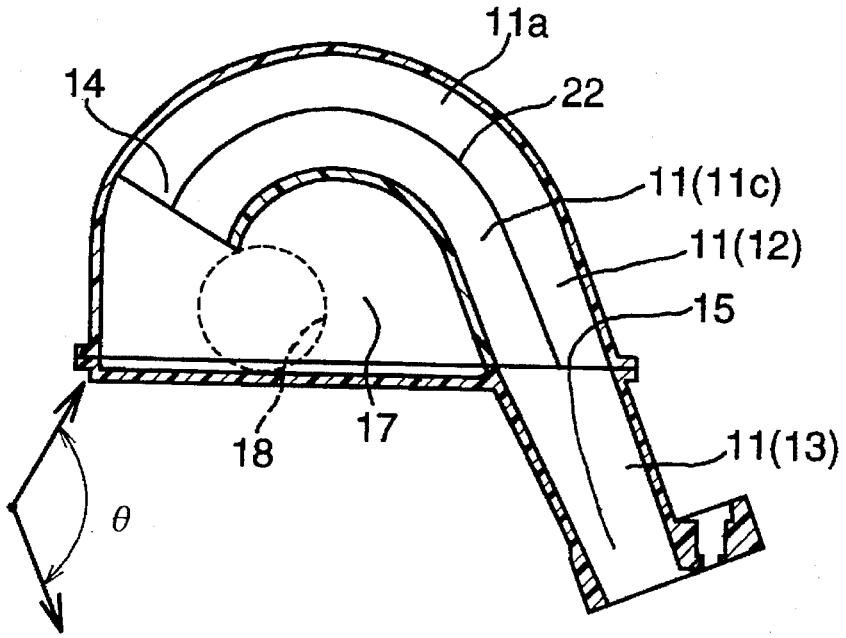
FIG. 14 is a transverse cross-sectional view of the composite intake manifold according to the seventh embodiment of the present invention.

In the seventh embodiment of the present invention, as illustrated in FIGS. 12–14, the composite intake manifold is for a four-cylinder internal combustion engine. The first outer member 1G, the inner member 2G, and the second outer member 3G are constructed of, for example, synthetic resin. The second outer member 3G forms another portion (a straight portion 13) of the intake port 11. The portion 13 of the intake port 11 formed in the second outer member 3G is provided on only one side of the longitudinal axis of the composite intake manifold.

The first outer member 1G and the inner member 2G form a plurality of curved portions 12 of the intake ports 11 which are parallel to each other. All of the curved portions 12 of the intake ports are directed in the same direction, that is, the direction from the inlet portion to the outlet portion of the curved portion 12 of each intake port 11 is the same.

In FIG. 14, by selecting an angle θ between an axis of an inlet portion and an axis of an outlet portion of the curved portion 12 of the intake ports 11, the length of the curved portion 12 of the intake ports 11 can be adjusted to a desired length. As a result, torque and power can be increased compared to those of the conventional engine.

Figure 15:
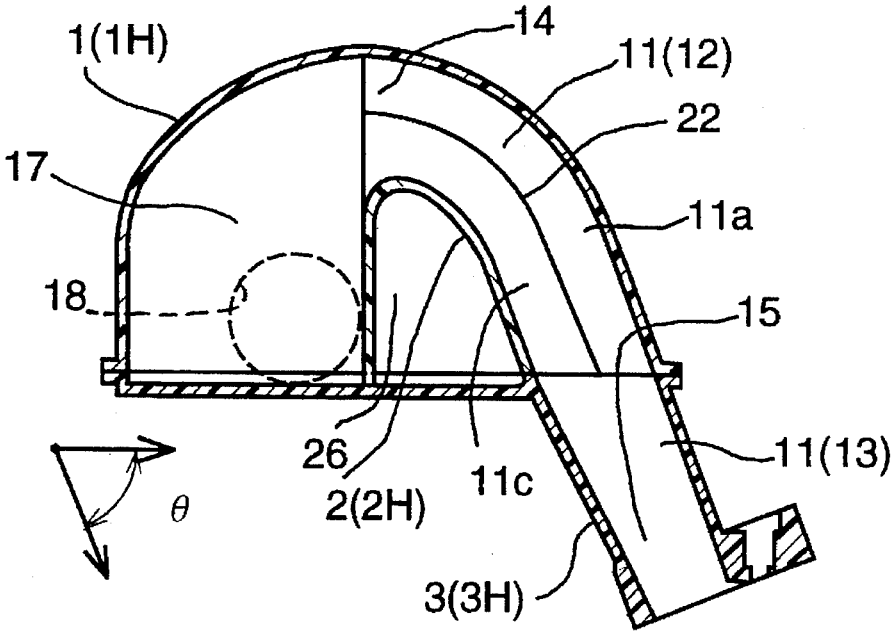
FIG. 15 is a transverse cross-sectional view of a composite intake manifold according to an eighth embodiment of the present invention.

With the eighth embodiment of the present invention, as illustrated in FIG. 15, the inner member 2H forms therein a surge tank portion 17 and a dead space portion 26 isolated from the surge tank portion 17. In the composite intake manifold illustrated in FIG. 14, a volume of the surge tank portion 17 is necessarily increased when the intake port is shortened. However, in some cases, it is necessary to select an intake port length and a surge tank volume independently of each other. The composite intake manifold of the type of FIG. 15 can satisfy such requirement. Other structures and advantages are the same as those of the seventh embodiment of the present invention.

Figure 16:
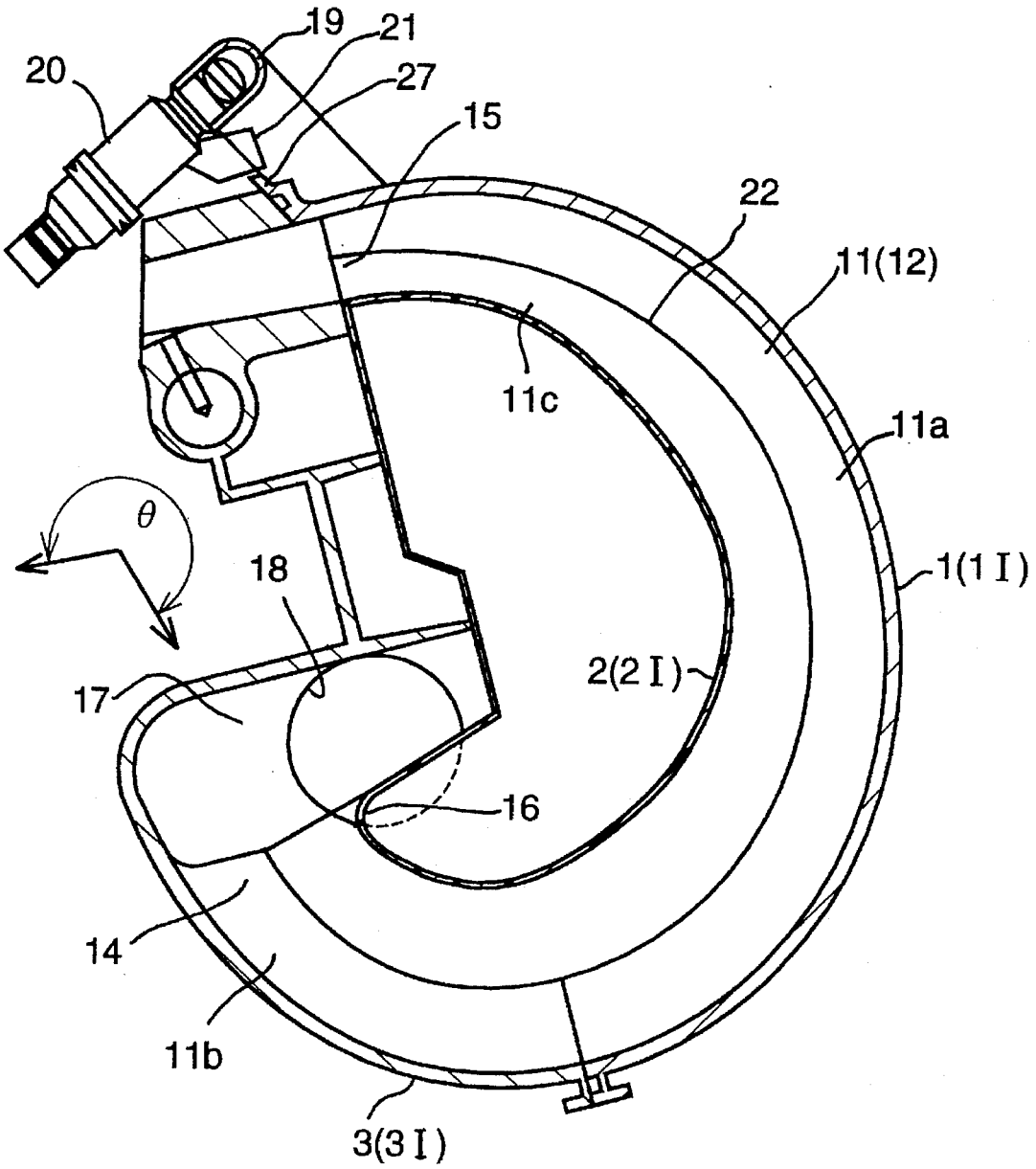
FIG. 16 is a cross-sectional view of a composite intake manifold according to a ninth embodiment of the present invention.
Figure 17:
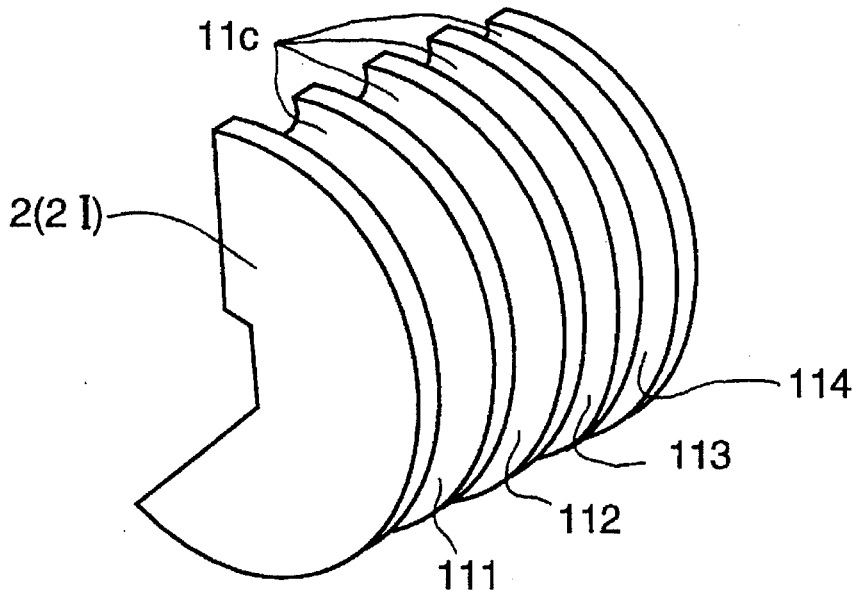
FIG. 17 is a perspective view of an inner member of the composite intake manifold according to the ninth embodiment of the present invention.
Figure 18:
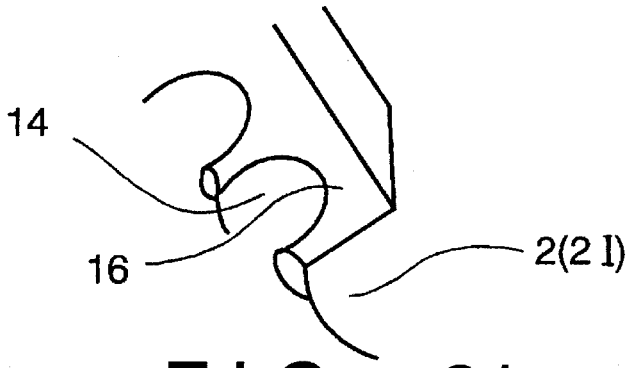
FIG. 18 is a perspective view of an inlet portion of an intake port of the inner member of FIG. 17.

With the ninth embodiment of the present invention, as illustrated in FIGS. 16–18, the intake port 11 is wound more than 180° so that an angle θ between an axis of an inlet portion 14 of the intake port 11 and an axis of the outlet portion 15 of the intake port 11 is greater than 180°. Owing to this structure, an intake port is much longer that those of the first to eighth embodiments of the present invention. The portions 11*a* and 11*b* of the intake port 11 outside of the axis of the curved portion 12 of the intake port 11 are formed in both the first outer member 1I and the second outer member 3I. The portion 11C of the intake port inside the axis of the curved portion 12 of the intake port 11 is formed in the inner member 2I. The first outer member 1I and the second outer member 3I are constructed of, for example, aluminum alloy, and the inner member 2I is constructed of, for example, synthetic resin.

A delivery pipe 19 is formed integrally with either the first outer member 1I or the second outer member 3I. The assembly is possible by combining the two outer members 1I and 3I in an axial direction of an injector 20 (a fuel injection valve). Because the delivery pipe is integrally formed with one of the outer members, the number of the assembly components is reduced, thereby reducing manufacturing cost. Further, a flange 27 of the first outer member 1I can be used as a stopper for preventing the injector 20 from rotating about an axis of the injector by lengthening the flange 27 and engaging connector 21 with the lengthened flange 27.

The inner member 2I comprises a hollow structure constructed of synthetic resin and formed through blow injection molding. The portion 11*c* of the intake port 11 inside the axis of the curved portion 12 of the intake port 11 comprises a concave portion (a groove) formed in a wall of the structure. Because of blow molding, the dimensional accuracy of the molded inner member 2I is very high, and the molding cost is low. Molding is also well-suited for mass production.

The inner member 2I extends over substantially the entire longitudinal length of the composite intake manifold so that the portions 11*c* of all respective intake ports 11, including ports 111, 112, 113, and 114, are formed in the inner member 2I (see FIG. 17). A bell mouth 16 is formed at an inlet of each intake port 11 to reduce flow resistance.

An interior of the inner member 2I of a synthetic resin container may or may not communicate with the surge tank portion 17, as desired. By selecting communication or non-communication therebetween, the volume of the surge tank portion 17 can be controlled.

Figure 21:
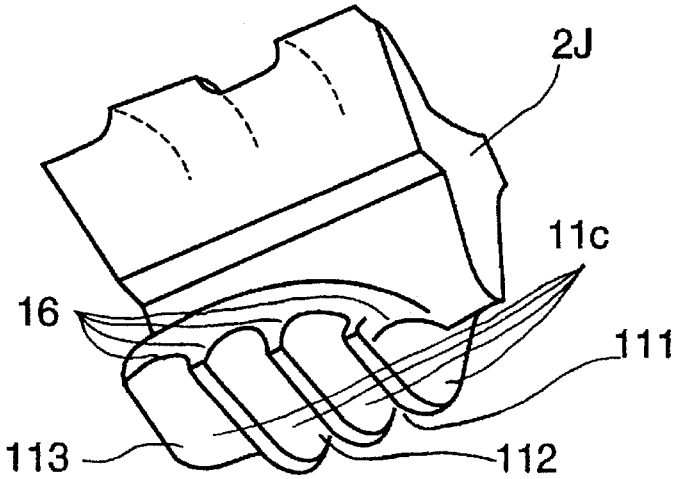
FIG. 21 is a perspective view of the inner member as viewed from a direction opposite to the viewpoint of FIG. 19.
Figure 19:
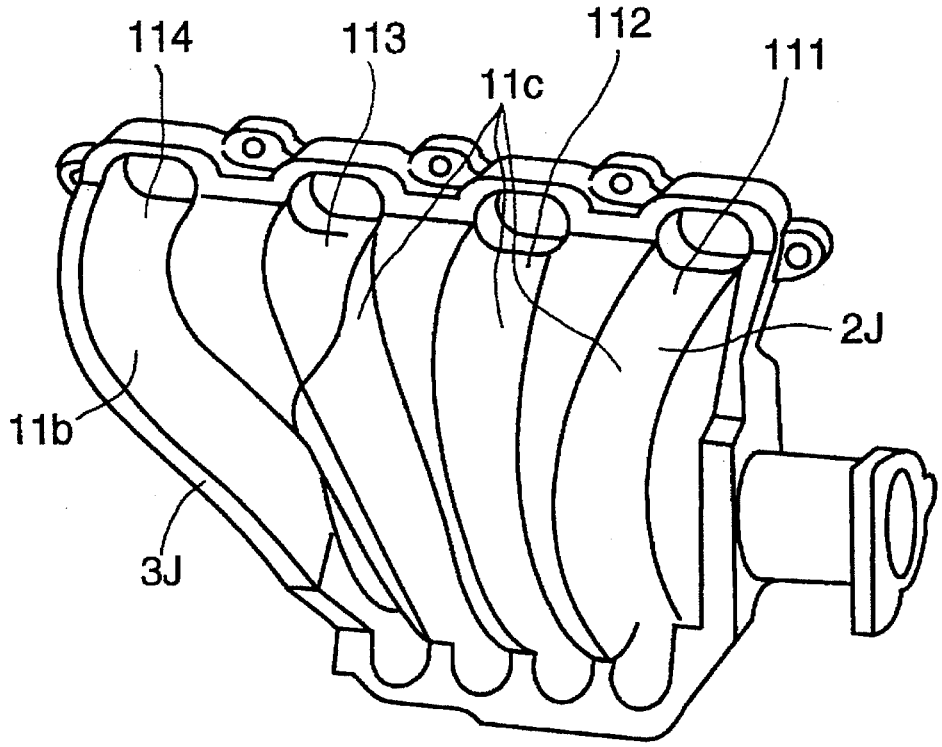
FIG. 19 is a perspective view of a second outer member and an inner member coupled to the second outer member, of a composite intake manifold according to a tenth embodiment of the present invention.
Figure 20:
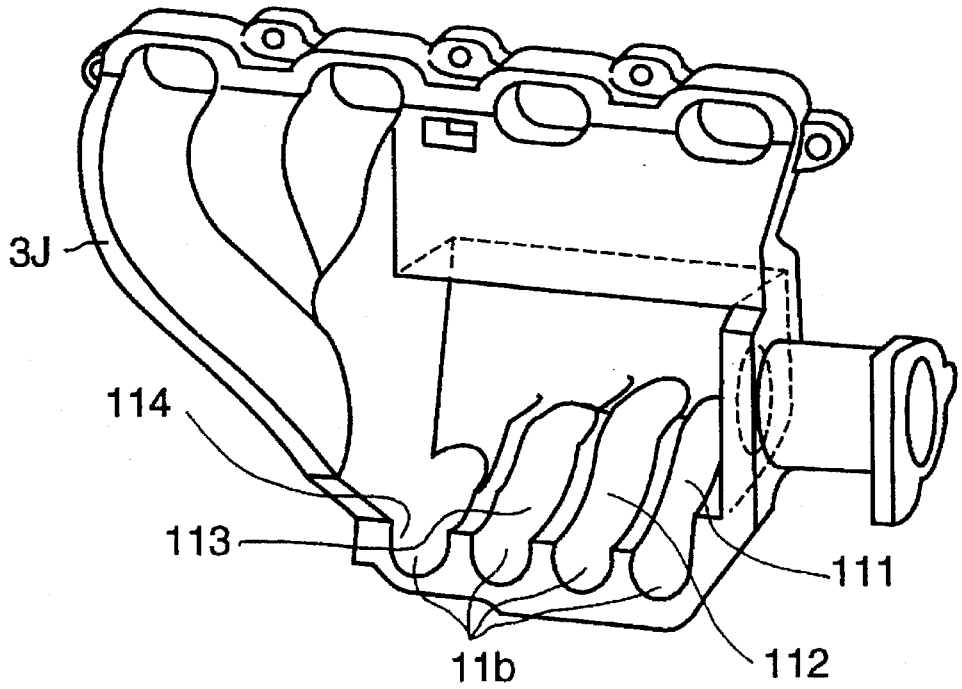
FIG. 20 is a perspective view of the second outer member, from which the inner member is separated, of FIG. 19.

With the tenth embodiment of the present invention, as illustrated in FIGS. 19–21, the inner member 2J extends over only a portion of a longitudinal length of the composite intake manifold. The inner member 2J forms the intake port portion 11*c* inside the axis of the curved portion 12 of only a portion of the intake ports 111, 112, and 113 (partially with port 113). Remaining intake ports 114 and 113 (a remaining portion of port 113) are formed by the first outer member 1J and the second outer member 3J, without inner member 2J. This type of structure may be used for an intake manifold having intake ports increased in interval toward a downstream direction.

Since the portions 11*c* of some of the intake ports 111, 112, 113, and 114 are not formed in the inner member 2J, the freedom of designing the inner member 2J is large. Other structures and advantages are the same as those of the ninth embodiment of the present invention.

Figure 22:
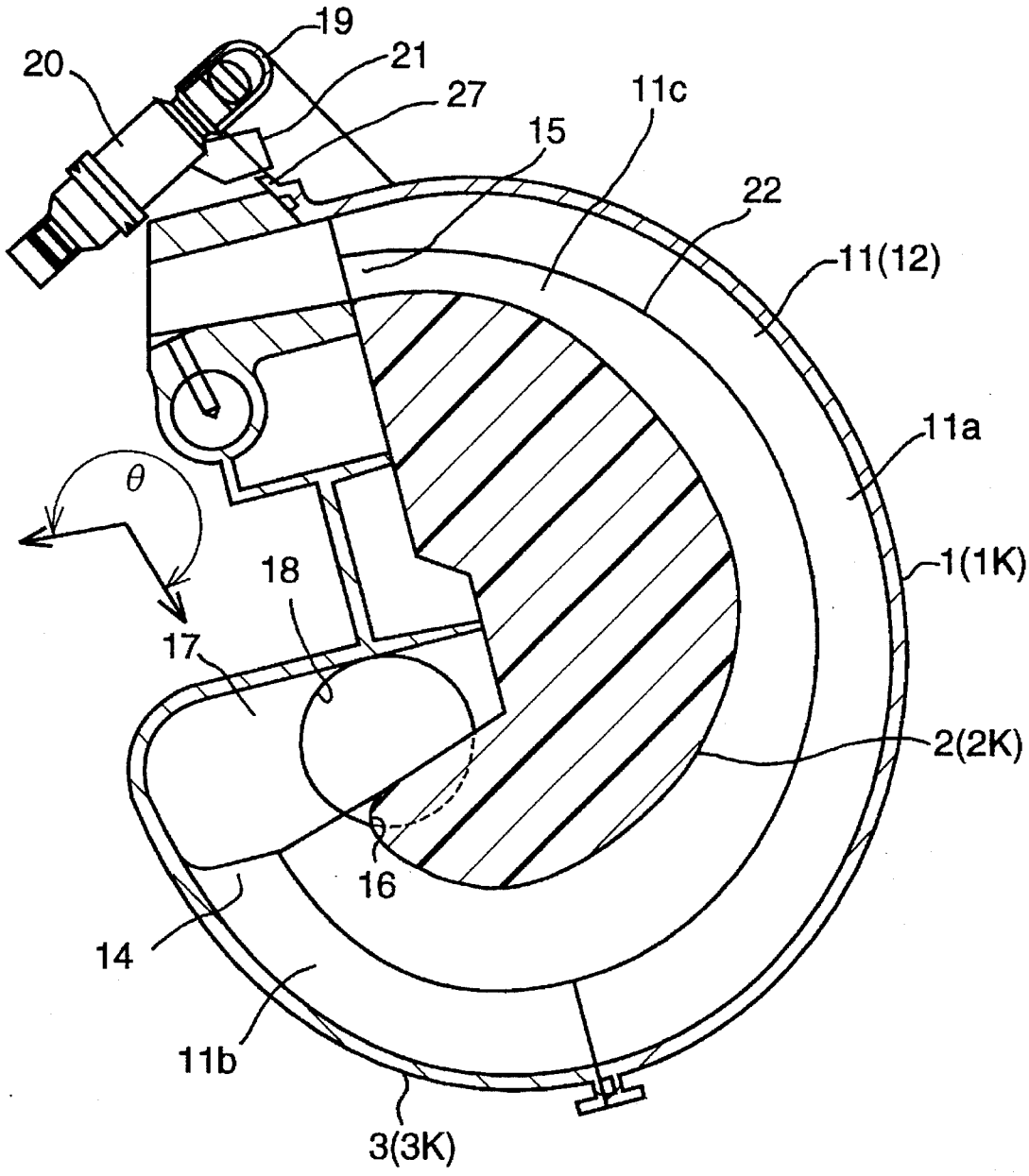
FIG. 22 is a transverse cross-sectional view of a composite intake manifold according to an eleventh embodiment of the present invention.

With the eleventh embodiment of the present invention, as illustrated in FIG. 22, the inner member 2K comprises a block constructed of resiliently compressible foam synthetic resin. The portion 11*c* inside the axis of the curved portion 12 of the intake port 11 comprises a concave portion or a groove formed at an outside surface of the block.

The inner member 2K is formed so as to be slightly larger size than a design size so that the inner member 2K makes tight contact at seams 22 of the intake port 11 by the first outer member 1K and the second outer member 3K, when the inner member 2K is held between the first outer member 1K and the second outer member 3K. Accordingly, the seal between adjacent intake ports 11 is improved so that torque and power are improved compared with the ninth embodiment of the present invention. Other structures and advantages are the same as those of the ninth embodiment of the present invention.

Although only eleven embodiments of the present invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. An engine intake manifold comprising:

a first outer member;

an inner member fitted within said first outer member; and a second outer member fixed to said first outer member, said first outer member and said second outer member holding said inner member therebetween, said first outer member, said inner member, and said second outer member collectively defining at least one intake port, said at least one intake port including a curved portion being defined by said inner member and at least one of said first outer member and said second outer member, said inner member and said at least one of said first outer member and said second outer member being joined at a seam at said curved portion.

2. A composite intake manifold according to claim 1, wherein at least the inner member is made from a resin.

3. A composite intake manifold according to claim 2, Wherein said first outer member is made from a resin.

4. A composite intake manifold according to claim 2, wherein both said first outer member and said second outer member are made from a resin.

5. A composite intake manifold according to claim 1, wherein said inner member end said second outer member define a surge tank portion therein.

6. A composite intake manifold according to claim 1, wherein said inner member is separable from said first outer member and said second outer member.

7. A composite intake manifold according to claim 1, wherein said et least one intake port includes an inlet having a bell mouth.

8. A composite intake manifold according to claim 1, wherein said curved portion of said at least one intake port has an inlet portion having an axis and an outlet portion having an axis, an angle θ between said axis of said inlet portion end said axis of said outlet portion being no greater than 180°, wherein said curved portion is defined by said inner member and only said first outer member.

9. A composite intake manifold according to claim 8, wherein said second outer member defines a substantially straight portion of said at least one intake port therein, said straight portion being substantially continuous in a circumferential direction of said intake port.

10. A composite intake manifold according to claim 9, wherein the portion of the intake port formed in the second outer member is provided on each side of the longitudinal axis of the composite intake manifold.

11. A composite intake manifold according to claim 10, wherein a plurality of intake ports are provided, wherein said first outer member and said inner member define a plurality of parallel curved portions of said plurality of intake ports, wherein adjacent curved portions extend in opposite directions.

12. A composite intake manifold according to claim 8, wherein said angle θ is greater than 90°.

13. A composite intake manifold according to claim 8, wherein said first outer member and said inner member are abutted with each other at said interface.

14. A composite intake manifold according to claim 8, wherein said angle θ is equal to or less than 90°.

15. A composite intake manifold according to claim 8, wherein said first outer member and said inner member have opposing intake port wall edge surfaces at said interface therebetween, one of said opposed edge surfaces having a groove formed therein into which a seal member is fitted.

16. A composite intake manifold according to claim 8, wherein said first outer member end said inner member each have a plurality of sealing surfaces which are engaged at said interface between said first outer member and said inner member, wherein said sealing surfaces of said first outer member end said sealing surfaces of said inner member are engaged in the same orientation relative to each said at least one intake port.

17. A composite intake manifold according to claim 8, wherein said first outer member end said inner member have a plurality of sealing surfaces which are engaged with one another at said interface between said first outer member and said inner member, wherein said sealing surfaces of said first outer member end said inner member are engaged in an alternating manner.

18. A composite intake manifold according to claim 8, wherein an intake gas inlet is provided between et least one pair of said intake ports, wherein said intake ports of each said pair of intake ports extend in opposite directions relative to each other.

19. A composite intake manifold according to claim 18, wherein said second outer member defines a portion of said intake ports therein on opposing sides.

20. A composite intake manifold according to claim 8, wherein said second outer member defines a portion of said intake ports therein, said portion of said intake ports formed in the second outer member extending in one direction.

21. A composite intake manifold according to claim 20, wherein said first outer member and said inner member define a plurality of parallel curved portions of said intake ports, all of said curved portions of the intake ports extending in the same direction.

22. A composite intake manifold according to claim 21, wherein a surge tank portion end a dead space portion which is isolated from the surge tank portion ere defined by said inner member.

23. A composite intake manifold according to claim 1, wherein said curved portion of said at least one intake port has an inlet portion having an axis and an outlet portion having an axis, wherein an angle θ between said axis of said inlet portion and said axis of said outlet portion is greater than 180°, end wherein said curved portion is defined by said inner member and both said first outer member and said second outer member.

24. A composite intake manifold according to claim 23, wherein said inner member comprises a hollow resin structure wherein said curved portion of said at least one intake port is at least partly defined by a groove formed in a wall of said hollow resin structure.

25. A composite intake manifold according to claim 23, wherein an axis of said at least one intake port extends transversely to a longitudinal direction of said manifold and, wherein said inner member has a length substantially equal to a length of said first outer member in a direction parallel to said longitudinal direction.

26. A composite intake manifold according to claim 23, wherein said inner member has a longitudinal length less then that of said first outer member.

27. A composite intake manifold according to claim 23, wherein the inner member is made from a foam resin block and said curved portion is at least partly defined by a groove formed at an outside surface of said resin block.

28. A composite intake manifold according to claim 27, wherein the inner member is resiliently compressible and is formed larger than a space between said first and second outer members, such that said inner member is compressively disposed between said first and second outer members.

* * * * *